US008011146B2

(12) United States Patent
Krause

(10) Patent No.: US 8,011,146 B2
(45) Date of Patent: Sep. 6, 2011

(54) BLAST-PROOF WINDOW AND MULLION SYSTEM

(76) Inventor: William Krause, Fords, NJ (US)

( * ) Notice: Subject to any disclaimer, the term of this patent is extended or adjusted under 35 U.S.C. 154(b) by 928 days.

(21) Appl. No.: 12/002,809

(22) Filed: Dec. 19, 2007

(65) Prior Publication Data

US 2011/0113706 A1 May 19, 2011

(51) Int. Cl.
*E04H 1/00* (2006.01)

(52) U.S. Cl. ..... 52/235; 52/464; 52/468; 89/36.04

(58) Field of Classification Search ..... 52/235, 52/464, 468; 89/36.02, 36.04, 904, 920, 89/937; 428/911
See application file for complete search history.

(56) References Cited

U.S. PATENT DOCUMENTS

| | | | | |
|---|---|---|---|---|
| 3,052,330 | A * | 9/1962 | Hammitt et al. | 52/235 |
| 3,367,077 | A * | 2/1968 | Johnston | 52/464 |
| 3,509,674 | A * | 5/1970 | Birum, Jr. | 52/302.1 |
| 5,546,713 | A * | 8/1996 | Voegele et al. | 52/202 |
| 5,592,795 | A * | 1/1997 | Rinehart et al. | 52/235 |
| 6,141,923 | A * | 11/2000 | Habicht et al. | 52/235 |
| 6,401,410 | B2 * | 6/2002 | Kenny et al. | 52/235 |
| 6,804,920 | B2 * | 10/2004 | Hogan | 52/235 |
| 7,562,504 | B2 * | 7/2009 | Herbst et al. | 52/461 |
| 7,823,346 | B2 * | 11/2010 | Lang | 52/235 |
| 7,832,180 | B2 * | 11/2010 | Dolby | 52/848 |
| 2004/0079038 | A1 * | 4/2004 | Crooker, Jr. | 52/235 |
| 2005/0060950 | A1 * | 3/2005 | Hauschildt et al. | 52/235 |

* cited by examiner

*Primary Examiner* — Robert J Canfield
*Assistant Examiner* — Matthew J Gitlin
(74) *Attorney, Agent, or Firm* — Ezra Sutton

(57) ABSTRACT

A blast-proof window and mullion system for sustaining and mitigating an explosion and/or blast to the window and mullion system on a multi-storied building or structure. The window and mullion system includes a blast-resistant mullion having a mullion housing with mullion walls with outer surfaces; and a pressure bar member having a pressure bar housing with an interior wall and a pair of outer walls being connected to the interior wall to form a center channel opening. The outer walls are angled for reducing the space between the angled walls and for reducing the size of the center channel opening for reduction of bullet and/or blast penetration to the interior wall of the pressure bar member. Also, one of the mullion walls of the mullion housing includes a mullion tongue thereon having a pair of tongue extension arms for forming a vertical bolt receiving channel therebetween. Each of the tongue extension arms have interior serrated surfaces for receiving threaded bolts between the interior serrated surfaces. The interior wall of the pressure bar member has a pair of spaced-apart pressure bar extension arms thereon. The interior wall of the pressure bar member includes a plurality of spaced-apart bolt openings for receiving a plurality of the threaded bolts therein for permanently locking together the pressure bar extension arms with the mullion extension arms in order to join together and lock the pressure bar housing of the pressure bar member to said mullion housing of the blast-resistant mullion to form the blast-proof window and mullion system.

30 Claims, 10 Drawing Sheets

BLAST-PROOF WINDOW AND MULLION SYSTEM

FIELD OF THE INVENTION

The present invention relates to a blast-proof window and mullion system having an improved and novel blast-resistant mullion in conjunction with an improved and novel blast-resistant and bullet-proof pressure bar member. More particularly, the blast-resistant mullion includes a mullion tongue having a pair of tongue extension arms all with serrated surfaces. The blast-resistant mullion also includes a pair of mullion receiving slots. The pressure bar member includes a pair of pressure bar arms also having serrated surfaces. Each of the serrated pressure bar arms are received within each of the mullion receiving slots of the blast-resistant mullion, such that these serrated surfaces have structural silicone adhesive thereon are for permanently locking together the pressure bar arms within the mullion receiving slots in order to integrally join together and lock the pressure bar member to the blast resistant mullion.

BACKGROUND OF THE INVENTION

Blast-remediation requirements for blast resistant windows, bullet proof windows and blast proof buildings are usually linked with the bombings of the World Trade Center and the Pentagon on Sep. 11, 2001. These attacks to our homeland, in reality, have been tracked by our own armed forces and the FBI since the early 1980's, starting with the 1983 U.S. Beirut embassy car bombing. The 9-11 tragedies in New York and at the Pentagon accelerated the process for the United States Federal Government to strengthen its buildings in order to protect the citizens of our nation. The General Service Administration (GSA) in 1995 had conducted a survey of 1239 buildings to assess risk factors for these buildings and had proposed a citation to protect these buildings from terrorist threats including bomb blasts. The risk assessment of these buildings ultimately resulted in a protection level matrix to help define the hazards and appropriate protection levels to each building, wherein a protection level 1 for a building represents the building has sustained and fully survived a bomb blast, such that the glass is not cracked and no window/glass/frame fragments are in either the inside or outside building structure. A protection level 5 for a building represents the windows and window frames failed catastrophically.

As it stands there is no single blast-remediation standard. GSA has a testing criterion and test protocol, but not a standard for blast mitigation. DOD uses the UFC 2003 recommendation, which stipulates a minimum of 7 KPA (1 psi) protection for all buildings with a standoff distance of 82 feet, and higher blast loads when the building is located less than 82 feet. All agencies of the federal government do accept the shock tube and the arena test methods as a way to verify compliance.

There remains a need for a blast-proof window system that has a minimum blast mitigation recommendation of at least 2.5 psi protection for a multi-storied building by the DOD. The blast-proof window system would include a novel and improved blast-resistant mullion in use with a blast-resistant and bullet-proof pressure bar member, both being made from a aluminum alloy 6063-T6. Additionally, the mullion and the pressure bar member would include serrated surfaces such that the blast-resistant mullion, the pressure bar member and the bullet-proof laminated windows are permanently locked together using a structural silicone adhesive thereon for forming the blast-proof window system of the present invention.

DESCRIPTION OF THE PRIOR ART

Bullet-proof window systems, bullet-proof windows and doors, blast-resistant multi-storied buildings, explosive resistant window framing systems and the like having various designs, configurations, structures and materials of construction have been disclosed in the prior art. For example, U.S. Pat. No. 6,185,882 to PEARSON discloses a bullet-resistant window assembly having a frame system that provides a neat and clean exterior and interior appearance. A multiple layer bullet-resistant glass unit is surrounded by a rectangular steel frame having a wide peripheral flange integrally connected to a narrow peripheral flange by a web. A set of spacer bars are welded to the narrow flange around the frame, and a set of extruded aluminum trim base strips extend around the frame and are secured by peripherally spaced screws to the spacer bars and to the wide flange of the steel frame. The trim base strips capture a peripheral portion of the glass unit which is sealed to the base strips by glazing materials such as silicone material and glazing tape. A set of steel reinforcing plates or strips are secured to the exterior and/or exterior base plates by the peripherally spaced screws and overlap the steel frame and a peripheral portion of the glass unit. A set of extruded aluminum trim strips or channels are snap-fitted onto the base strips for enclosing the steel reinforcing strips. This prior art patent does not teach or disclose the design, configuration and structure of a blast-proof window and mullion system having the novel blast-resistant mullion and pressure bar member of the present invention.

U.S. Pat. No. 6,718,705 to EMEK discloses a blast-resistant window system comprising a reinforced window pane defining an inside and an outside being supported by a window framework for mounting at an opening in a wall. The window system further includes at least one pane engaging member transversally extending adjacent an inside surface of the window pane and secured at respective ends thereof to opposite construction elements. Each of the pane-engaging members is fitted with at least one energy dispensing device for converting axial force within the pane-engaging member into mechanical work. This prior art patent does not teach or disclose the design, configuration and structure of a blast-proof window and mullion system having the novel blast-resistant mullion and pressure bar member of the present invention.

U.S. Pat. No. 6,912,817 to SABAK et al discloses a means for securing an impact-resistant panel within a frame by utilizing a restraint channel system. The channel resistant system is used for retaining an impact-resistant piece of glass that has been covered substantially on one face with a window film, within a frame, by utilizing an impact-resistant panel to the existing frame by use of the resistant channel system. This prior art patent does not teach or disclose the design, configuration and structure of a blast-proof window and mullion system having the novel blast-resistant mullion and pressure bar member of the present invention.

U.S. Publication No. 2005/0138889 to BIEBUYCK discloses a curtain wall system with enhanced resistance to blast forces. The curtain wall system includes at least one vertical mullion and at least one horizontal sill member. Either the vertical mullion, the horizontal sill member, or both are formed to include a channel of increased depth to facilitate the receipt of a panel member therein. The panel member is secured with a bonding agent. The channel of the vertical and horizontal mullions may be oriented near at least one of a front edge and a back edge or substantially near a center of the vertical mullion and horizontal sill member. This prior art patent does not teach or disclose the design, configuration and structure of a blast-proof window and mullion system having the novel blast-resistant mullion and pressure bar member of the present invention.

U.S. Publication No. 2005/0284046 to NEAL discloses a window framing for mitigating explosive blasts. The window framing system includes a threat (blast) side and a safe side that includes a base and a pressure plate that together form a part of one of a sill section, a head section, and a jam section of the window. The base and pressure plate are elongated in a longitudinal direction. The base has (1) an L-shaped cross-section at a near portion of the base to receive an end of a glazing unit from the threat side of the window; and (2) a first pocket formed in a far portion of the base and running in the longitudinal direction. The rear portion is closer to the threat side than the far portion. The pressure plate is to be assembled with the base so as to secure the glazing unit in the corner. This prior art patent does not teach or disclose the design, configuration and structure of a blast-proof window and mullion system having the novel blast-resistant mullion and pressure bar member of the present invention.

The aforementioned prior art references do not teach or disclose the design, configuration and structure of the improved blast-proof window and mullion system having a unique and novel pressure bar member in conjunction with a novel blast-resistant mullion in order to mitigate an explosion blast through the laminated window glass and through the blast-proof window and mullion system.

Accordingly, it is an object of the present invention to provide a blast-proof window and mullion system for mitigating and sustaining an explosion and/or blast through a plurality of laminated window glass and through the unique and novel blast-proof window system being made from an aluminum alloy 6063TG.

Another object of the present invention is to provide a blast-proof window and mullion system having an improved and novel blast-resistant mullion in conjunction with an improved and novel and bullet-proof pressure bar member.

Another object of the present invention is to provide a blast-proof window and mullion system wherein the blast-resistant mullion includes a mullion tongue having a pair of tongue extension arms all with serrated surfaces for joining to the pressure bar member.

Another object of the present invention is to provide a blast-proof window and mullion system having the blast-resistant mullion with a pair of mullion receiving slots being positioned on a front wall in a equally space-apart fashion, wherein the front wall also includes a pair of front wall surfaces with serrated surfaces for joining with the pressure bar member.

Another object of the present invention is to provide a blast-proof window and mullion system wherein the pair of tongue extension arms of the centrally positioned mullion tongue form a bolt receiving channel therein for receiving a plurality of steel securing bolts therethrough for locking the pressure bar member to the blast-resistant mullion.

Another object of the present invention is to provide a blast-proof window and mullion system including the blast-resistant pressure bar member having pressure bar housing with a rear wall and a pair of angled outer walls being integrally connected to the rear wall, wherein the angled outer walls has a channel opening therethrough, such that a reduced sized channel opening is used for reduction of bullet and/or blast penetration to the pressure bar member.

Another object of the present invention is to provide a blast-proof window and mullion system wherein the rear wall of the pressure bar member includes a pair of spaced-apart pressure arms thereon being centrally positioned, such that each of the pressure bar arms have exterior wall surfaces with serrated surfaces thereon for receiving structured silicone adhesive thereon for locking the pressure bar member to the blast-resistant mullion.

Another object of the present invention is to provide a blast-proof window and mullion system that is easy to install and assemble and withstand blast mitigation up to 8 psi for a multi-storied building.

A further object of the present invention is to provide a blast-proof window and mullion system that can be mass-produced in an automated and economical manner and as readily affordable by the builder.

SUMMARY OF THE INVENTION

In accordance with the present invention, there is provided a blast-proof window and mullion system for sustaining and mitigating an explosion and/or blast to the window and mullion system on a multi-storied building or structure. The window and mullion system includes a blast-resistant mullion having a mullion housing with mullion walls with outer surfaces; and a pressure bar member having a pressure bar housing with an interior wall and a pair of outer walls being connected to the interior wall to form a center channel opening. The outer walls are angled for reducing the space between the angled outer walls and for reducing the size of the center channel opening for reduction of bullet and/or blast penetration to the interior wall of the pressure bar member. The window and mullion system also includes a cover for overlapping the angled outer walls and for protecting the pressure bar member. Additionally, the window and mullion system includes a plurality of laminated shatter-proof and bullet-proof windows connected to the mullion housing and the pressure bar housing. Also, one of the mullion walls of the mullion housing includes a mullion tongue thereon having a pair of tongue extension arms for forming a vertical bolt receiving channel therebetween. Each of the tongue extension arms have interior serrated surfaces for receiving threaded bolts between the interior serrated surfaces. The interior wall of the pressure bar member has a pair of spaced-apart pressure bar extension arms thereon. Each of the pressure bar extension arms has exterior and interior serrated surfaces thereon for receiving structural adhesive thereon. The interior wall of the pressure bar member includes a plurality of spaced-apart bolt openings for receiving a plurality of the threaded bolts therein for permanently locking together the pressure bar extension arms with the mullion extension arms in order to join together and lock the pressure bar housing of the pressure bar member to the mullion housing of the blast-resistant mullion to form the blast-proof window and mullion system.

BRIEF DESCRIPTION OF DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE EMBODIMENTS

Preferred Embodiment 10

Figure 3:
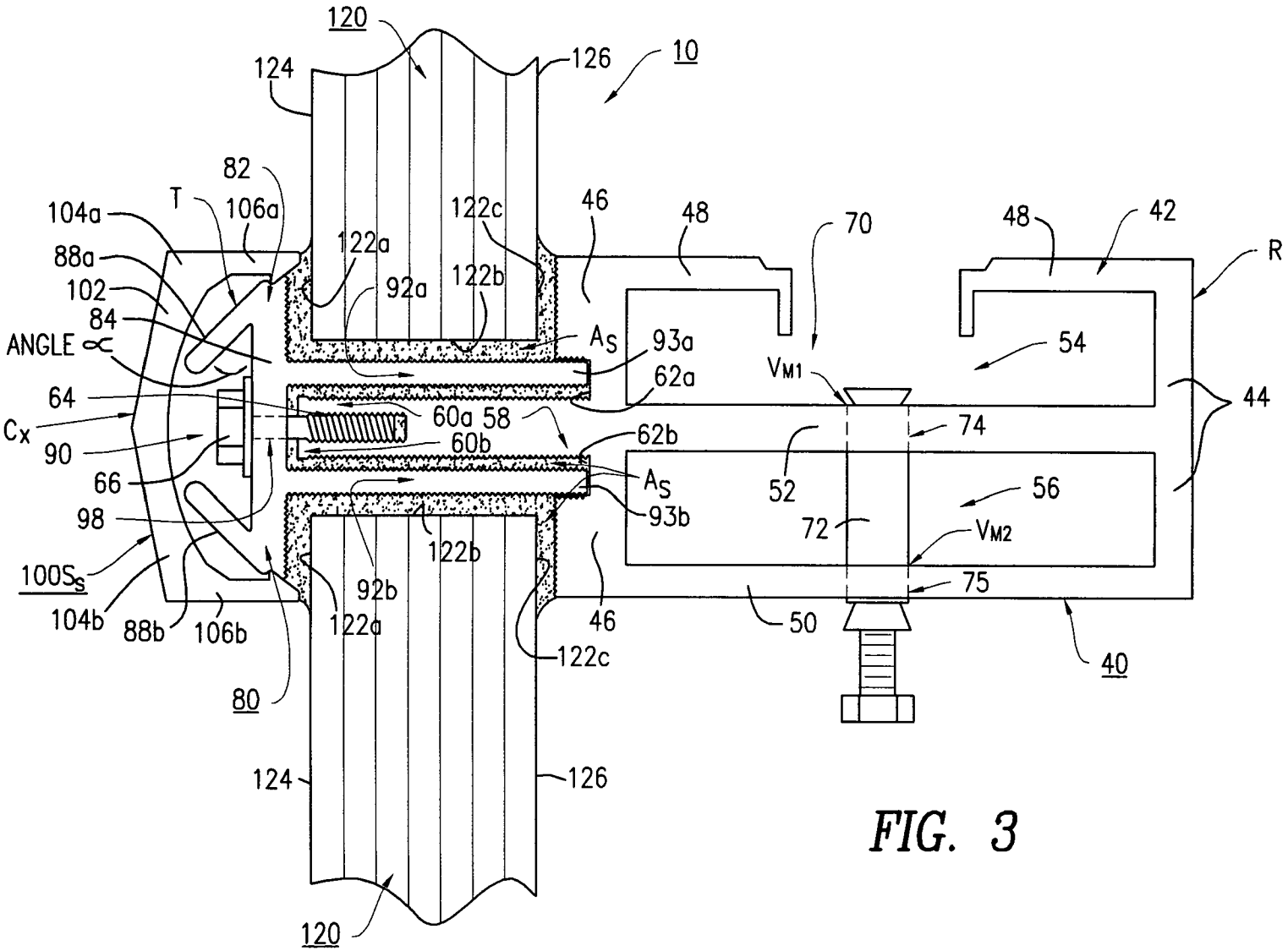
FIG. 3 is a top plan sectional view of the blast-proof window system of the preferred embodiment of the present invention showing the major component of the present invention showing the major component parts of the window system.

The blast-proof window mullion system 10 and their major component parts of the preferred embodiment of the present invention is represented in detail by FIGS. 3 through 8 of the patent drawings. The blast-proof window and mullion system 10 is used for sustaining and mitigating an explosion and/or a blast to the window and mullion system 10 on a multi-stored building. The window and mullion system 10 includes a blast-resistant mullion 40, a blast-resistant and bullet-proof pressure bar member 80, a cover member 100 and a plurality of laminated windows 120 being shatter-proof and bullet proof attached to the mullion 40 and pressure bar member 80, as shown in FIG. 3. The mullion 40 and pressure bar member 80 are made from an aluminum alloy 6063TG.

Figure 1:
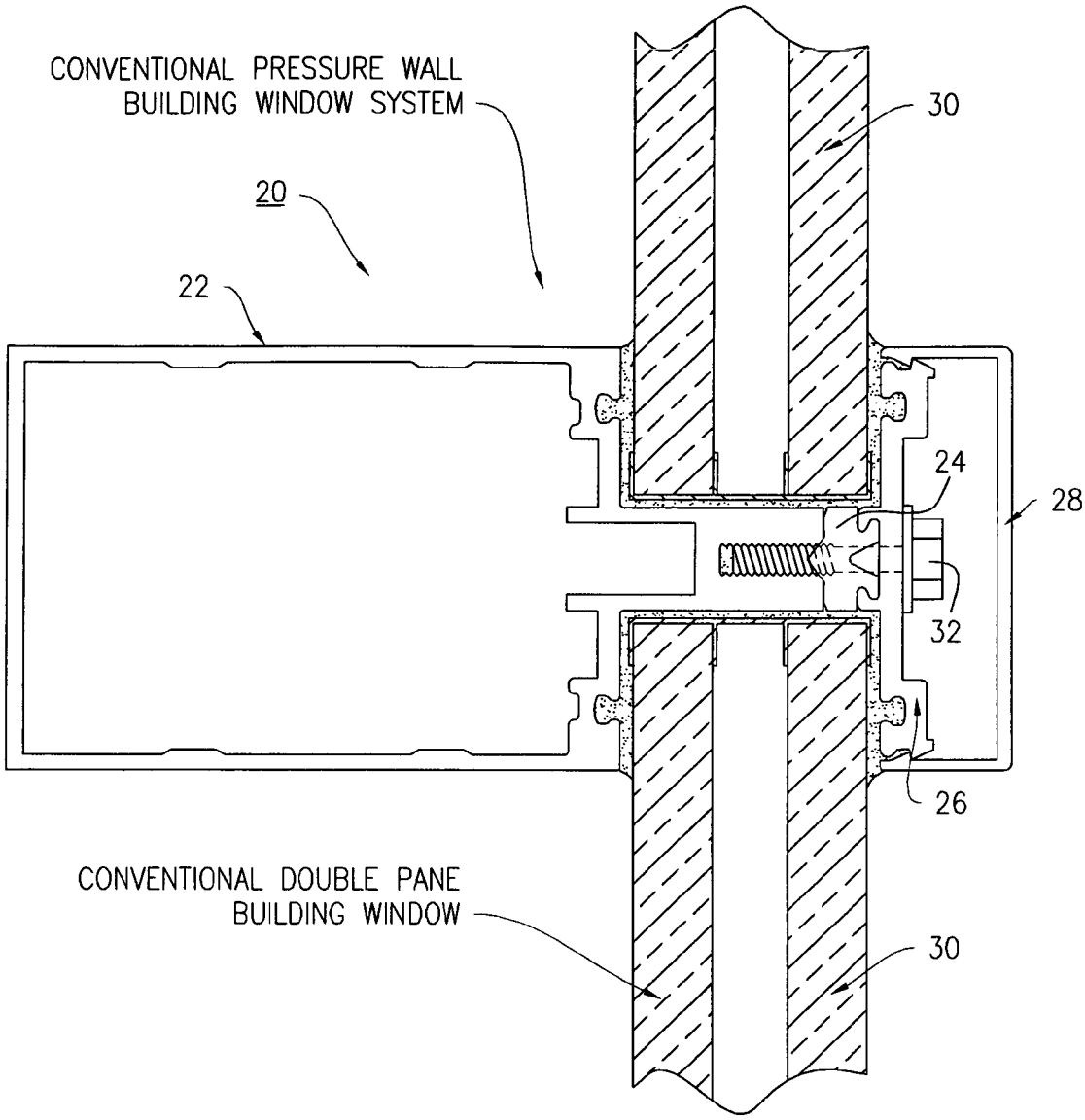
(PRIOR ART) FIG. 1
FIG. 1 is a top plan view of the conventional pressure wall window system of the prior art showing a standard pressure wall mullion, a mullion gasket, a conventional pressure bar, a bolt, a pressure bar cover and a pair of conventional double pane building windows.
Figure 2:
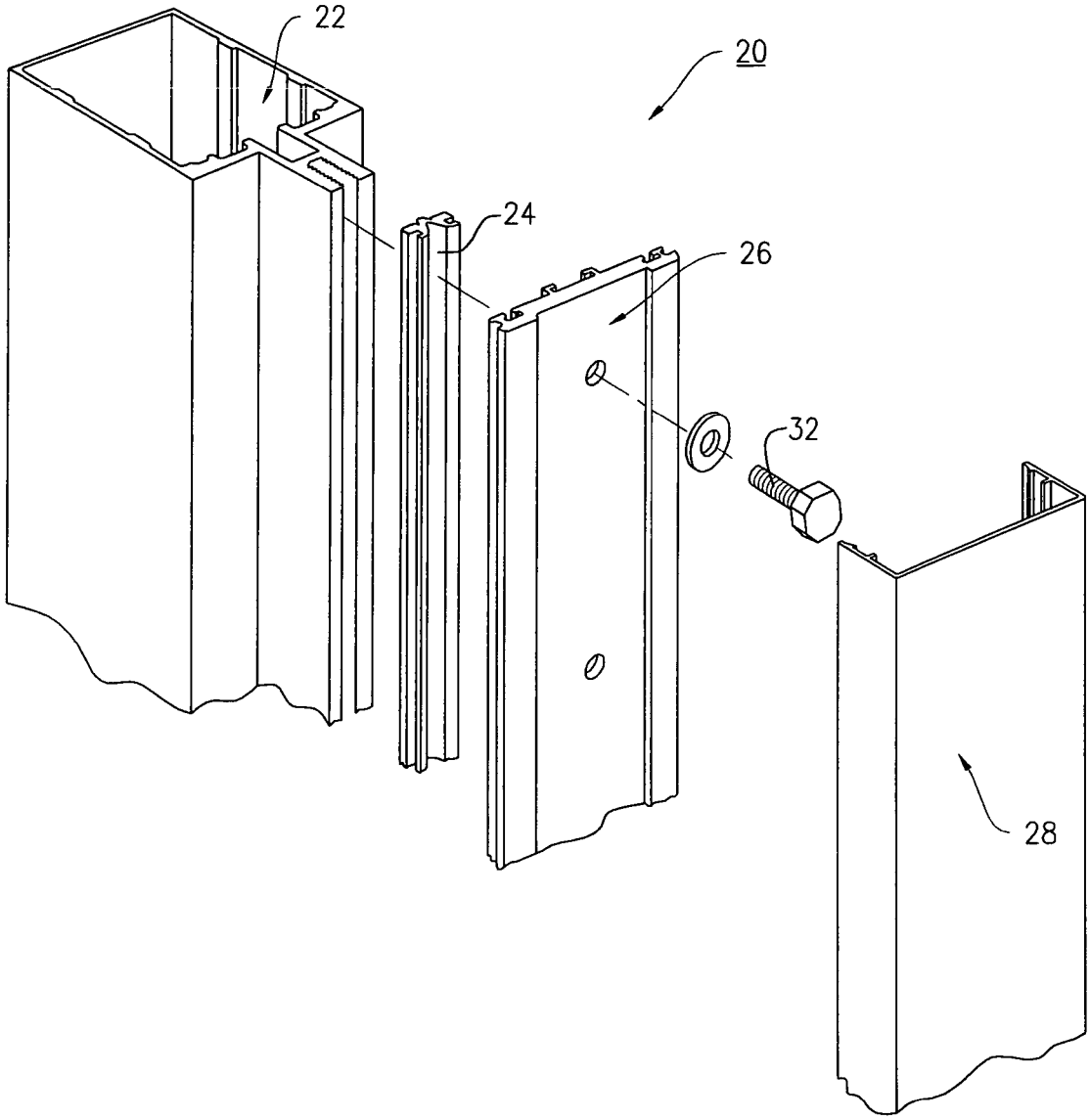
(PRIOR ART) FIG. 2
FIG. 2 is an exploded perspective view of the conventional pressure wall window system of the prior art showing the pressure wall mullion, the mullion gasket, the pressure bar, the bolt and the pressure bar cover.

As shown in the prior art, FIGS. 1 and 2 represent a conventional pressure wall system 20 having a pressure wall mullion 22, a pressure wall gasket 24, a pressure bar 26 and a cover member 28. The pressure wall system 20 also includes the use of conventional double pane building windows 30 in conjunction with the pressure wall mullion 22 and pressure bar 26, as depicted in FIG. 1, and being held together by a bolt 32. The window and mullion system 10 has a novel blast-resistant mullion 40 in use and in conjunction with a novel pressure bar member having a unique structural design and configuration as compared to the conventional pressure wall system 20 of the prior art. The major differences between the conventional structure and the present invention will become apparent in the forthcoming detailed description.

Figure 4:
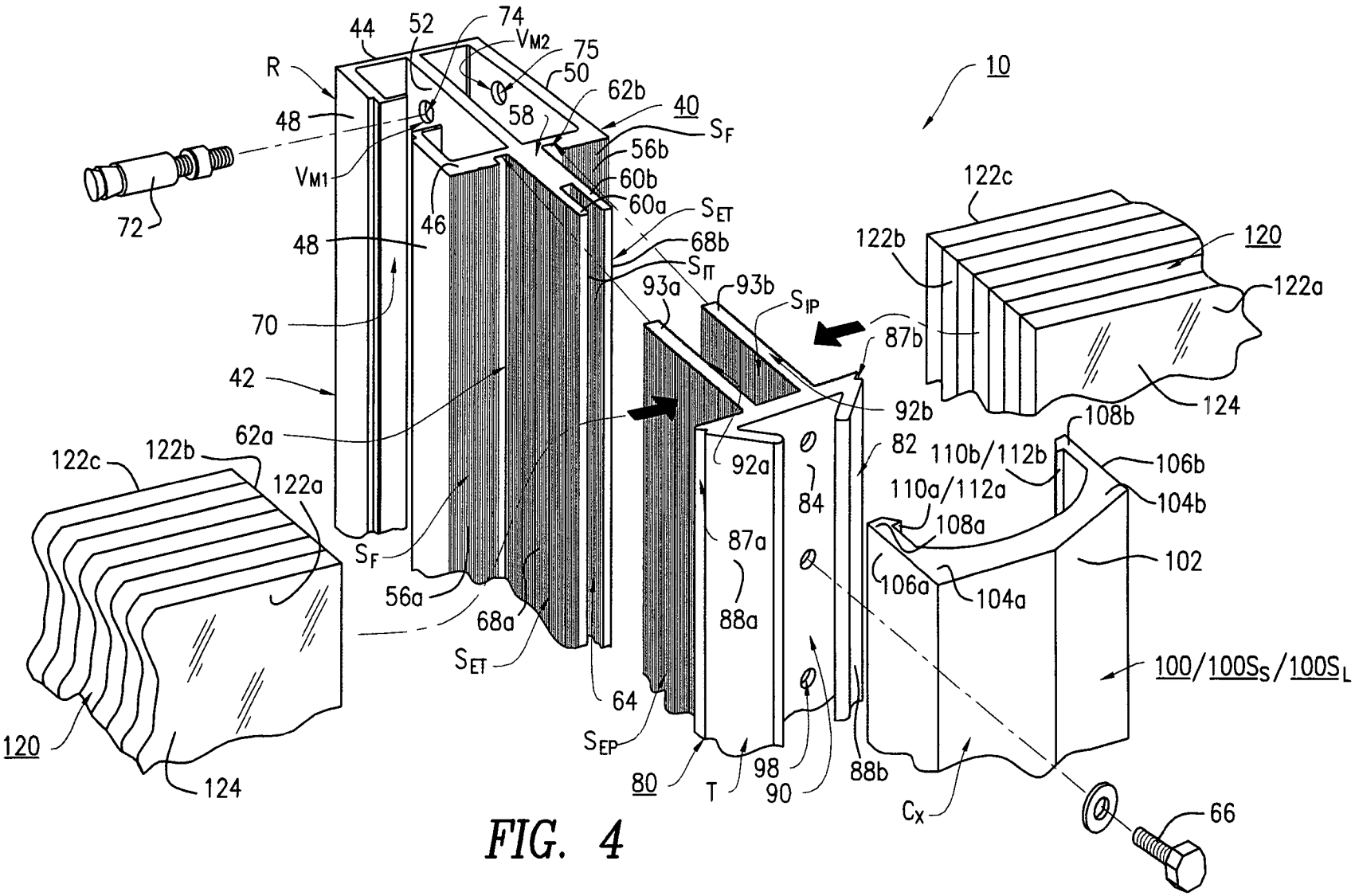
FIG. 4 is an exploded perspective view of the blast-proof window system of the present invention showing a blast-resistant mullion, a blast-resistant pressure bar, a snap-on pressure bar cover and a pair blast-resistant and bullet proof laminated windows.

As shown in FIGS. 3 through 6, the blast-resistant mullion 40 includes a mullion housing 42 having a rear wall 44, a front wall 46, side walls 48 and 50 and a center wall 52 for forming a pair of interior channels 54 and 56 therethrough. The mullion housing 42 is substantially rectangularly-shaped R, as depicted in FIG. 4. The front wall 46 has front wall outer surface 56*a*,56*b* and 56*c*, wherein each of the outer surfaces 56*a*,56*b* and 56*c*, have serrated surfaces $S_F$ thereon. The mullion housing 42 also includes a centrally-positioned mullion tongue 58 having a pair of tongue extension arms 60*a* and 60*b* thereon, the mullion tongue 58 in centrally positioned on the front wall 46, as shown in FIG. 4 of the drawings. The mullion tongue 58 has a width of at least ¾ of an inch±1/16 of an inch. The front wall 46 also includes a pair of mullion receiving slots 62*a* and 62*b*, each slot 62*a* and 62*b* being adjacent and in contact with the mullion tongue 58 of mullion housing 42. Each of the tongue extension arms 60*a* and 60*b* form a vertical bolt receiving channel 64 there between, such that each of the tongue extension arms 60*a* and 60*b* have interior serrated surfaces $S_{IT}$ for receiving threaded steel bolts 66 between the interior serrated surfaces $S_{IT}$ of the vertical bolt receiving channel 64, as depicted in FIGS. 3 and 4 of the drawings. Also, mullion tongue 58 includes outer side wall surfaces 68*a* and 68*b* each having an exterior serrated surface S thereon. As shown in FIGS. 3 and 4, one of the side mullion walls 48 or 50 includes an expansion bolt channel opening 70 for receiving an expansion bolt 72 therein. The center wall bolt openings 74 being aligned in a vertical axis $V_{M1}$ and being centrally positioned on the center wall 52. The other side mullion wall 50 of mullion housing 42 also includes a plurality of equally spaced-apart side wall bolt openings 75 being aligned in a vertical axis $V_{M2}$ and being centrally positioned on the side wall 50. The expansion bolt channel opening 70 is used at the jams of the window, such that the expansion bolts 72 are received through the spaced-apart center wall bolt opening 74 and spaced-apart side wall bolt openings 75 in order to permanently anchor the mullion housing 42 to a facade of a building using expansion bolts 72, as shown in FIGS. 3 and 4 of the drawings.

Figure 8:
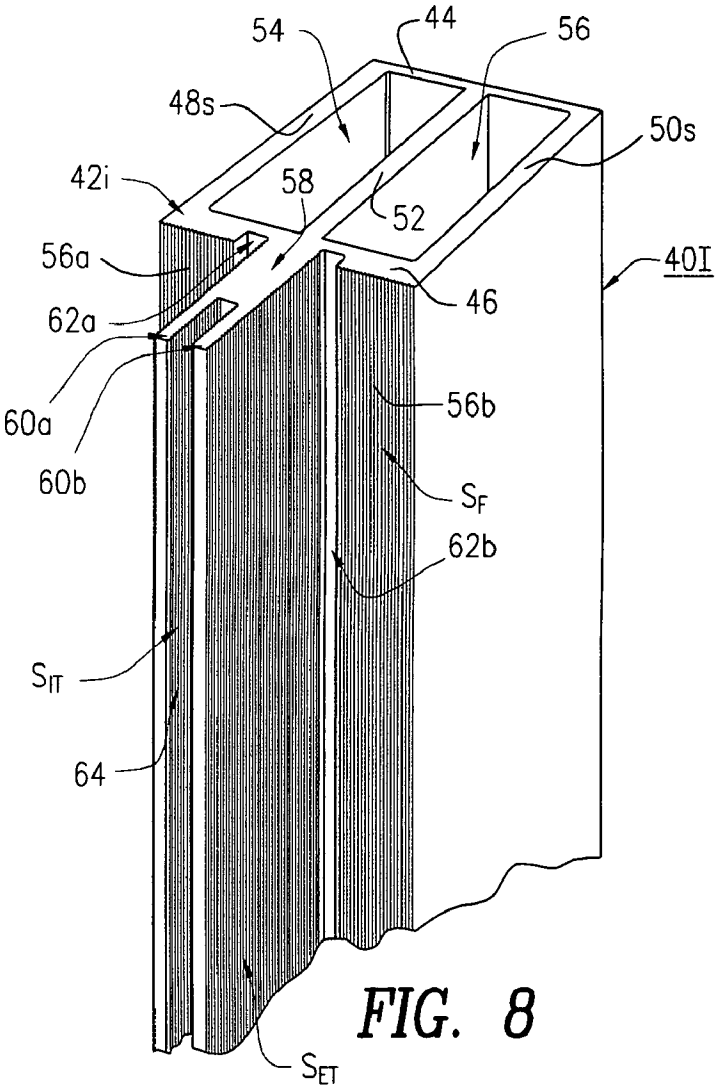
FIG. 8 is a front perspective view of the blast-proof window system of the present invention showing the serrated surfaces on the tongue extension arms, mullion tongue and the front wall of the mullion housing.
Figure 7:
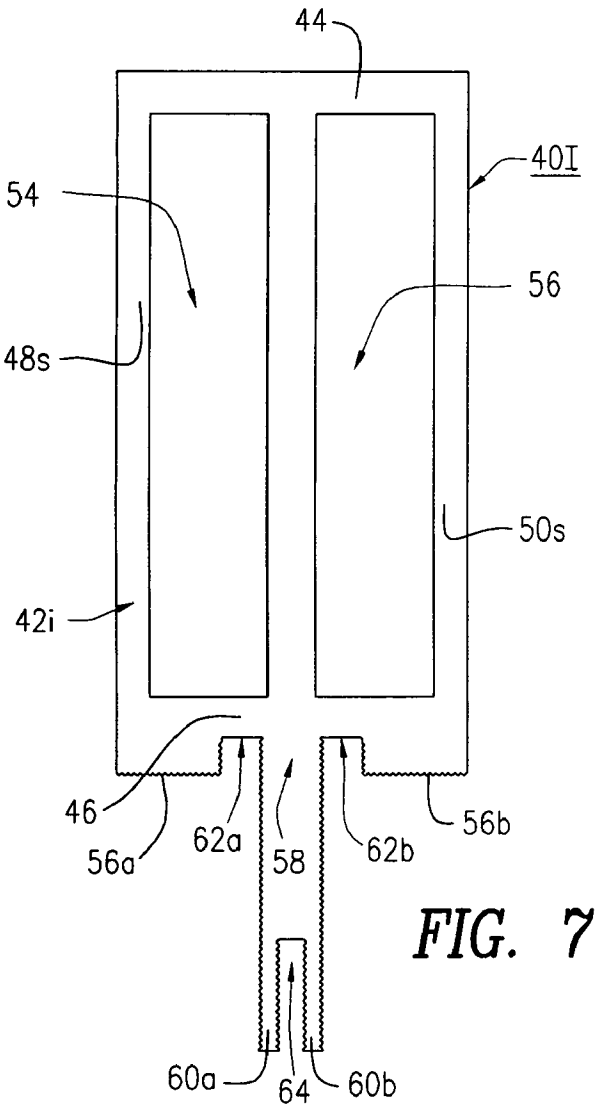
FIG. 7 is a top plan sectional view of the blast-proof window system of the first alternate embodiment of the present invention showing the blast-resistant mullion including a mullion housing having a mullion tongue with a pair of tongue extension arms thereon and a front wall having a pair mullion receiving slots thereon.

In an alternate design, as shown in FIGS. 7 and 8, the blast-resistant mullion 40I has a mullion housing 42*i* having its side mullion walls 48*s* and 50*s* being a solid and continuous wall, such that neither of the side mullion walls 48*s* and 50*s* include the expansion bolt channel opening 70. The mullion housing 42*i* is used as an intermediate blast-resistant mullion 40I and not a jam mullion 40 of the preferred embodiment 10.

Figure 6:
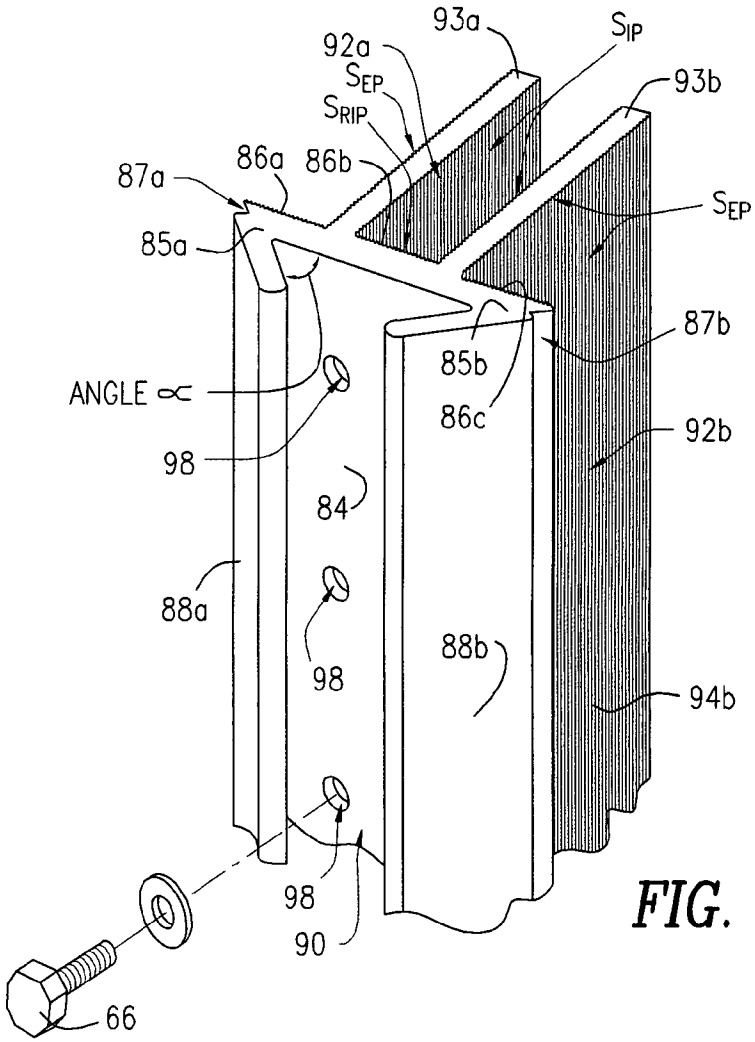
FIG. 6 is a front perspective view of the blast-proof window system of the present invention showing the blast-resistant pressure bar having angled outer walls and the rear wall with serrated pressure bar arms thereon.
Figure 5:
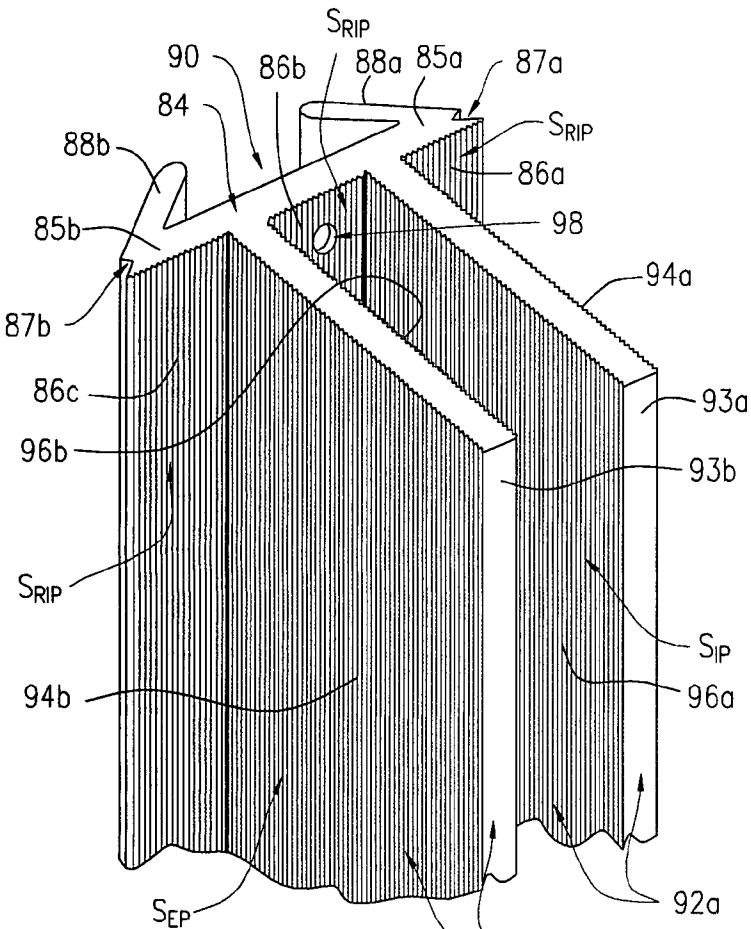
FIG. 5 is a rear perspective view of the blast-proof window system of the present invention showing the blast-resistant pressure bar having a pressure bar housing with a pair of angled outer walls, a rear wall having a pair of centrally positioned and spread-apart pressure bar arms, wherein the rear wall and the pressure bar arms base have serrated surfaces therein.

As shown in FIGS. 4 to 6, the blast-resistant pressure bar member 80 includes a pressure bar housing 82 having an interior wall 84 with rear interior wall surfaces 86*a*, 86*b* and 86*c*, wherein each of the rear interior wall surfaces 86*a* to 86*c* include serrated surfaces $S_{RIP}$. Pressure bar housing 82 also includes a pair of angled outer walls 88*a* and 88*b* connected to each end 85*a* and 85*b* of interior wall 84 at angle alpha(α) of 45° (relative to the interior wall 84) to form a channel pressure bar opening 90 being aligned in a vertical axis Vp. The pressure bar housing 82 is substantially triangularly-shaped T, as depicted in FIG. 4. Also, at each end 85*a* and 85*b* of interior wall 84 include a pair of cover receiving channels 87*a* and 87*b* for allowing the cover member 100 to attach to the interior wall 84 of pressure bar housing 82. The outer walls 88*a* and 88*b* are angled toward each other for reducing the space between the walls and for reducing the size of the channel opening 90 in order to reduce any bullet and/or blast penetration to the interior wall 84 of the pressure bar member 80. The width of channel opening 90 is not more than ¾ of an inch±1/16 of an inch. The interior wall 84 of the pressure bar housing 82 further includes a pair of spaced-apart pressure bar extension arms 92*a* and 92*b* thereon, being centrally positioned on the interior wall 84. Each of the pressure bar extension arms 92*a* and 92*b* include an end section 93*a* and 93*b*. Additionally, each of the pressure bar extension arms 92*a* and 92*b* include exterior and interior wall surfaces 94*a*, 94*b*, 96*a* and 96*b*, respectively, wherein each of the exterior and interior walls 94*a*, 94*b*, 96*a* and 96*b* include serrated surfaces $S_{EP}$ and $S_{IP}$, respectively as shown in FIG. 5 of the drawings. Further, the interior wall 84 of the pressure bar housing 82 includes a plurality of equally spaced-apart bolt openings 98 for receiving a plurality of the threaded steel bolts 66 therein for permanently locking together the pressure bar extension arms 92*a* and 92*b* with the tongue extension arms 60*a* and 60*b*. In this manner the pressure bar extension arms 92*a* and 92*b* and the tongue extension arms 60*a* and 60*b* are joined together and lock the pressure bar housing 82 of pressure bar member 80 to the mullion housing 42 of blast-resistant mullion 40 to form the blast-proof window and mullion system 10 of the preferred embodiment. The equally spaced-apart bolt openings 98 are equally spaced-apart between every four (4) to eight (8) inches on the interior wall 84 of pressure bar housing 82.

Additionally, each of the end sections 93*a* and 93*b* the pressure bar extension arms 92*a* and 92*b* are received within each of the spaced-apart mullion receiving slots 62*a* and 62*b* of mullion housing 42, respectively, for also locking and joining together the pressure bar housing 82 to the mullion housing 42 for forming the blast-proof window and mullion system 10 of the preferred embodiment, as shown in FIG. 3 of the drawings.

The pressure bar member 80 also includes a cover member 100 for overlapping the angled outer walls 88*a* and 88*b* in order to protect the pressure bar housing 82, as shown in FIGS. 3 and 4 of the drawings. The cover member 100 includes an outer cover wall 102, wherein the outer cover wall 102 has a convex-curved shape Cx for deflecting of bullets and/or blast debris from entering the channel pressure bar opening 90. Each of the side walls 106*a* and 106*b* include distal ends 108*a* and 108*b*, respectively. Each of the distal ends 108*a* and 108*b* include snap-on tabs 110*a* and 110*b* for, respectively, mating together with cover receiving channels 87*a* and 87*b* of pressure bar housing 82 for allowing the cover member 100 to attach to the interior wall 84 of pressure housing 82, thus forming a snap-on cover member 100 $S_S$. Alternatively, snap-on tabs 110*a* and 110*b* can be replaced with slide-on receiving channels 112*a* and 112*b*, respectively, for mating together with cover receiving channels 87*a* and 87*b* for allowing the cover member 100 to attach to the interior wall 84 of pressure bar housing 82, thus forming a slide-on cover member 100 $S_L$. Cover member 100 is also made from the aluminum alloy 6063TG.

As shown in FIGS. 3 and 4, the window and mullion system 10 includes a plurality of laminated windows 120 for connecting to the mullion housing 42 and the pressure bar housing 82. The laminated windows 120 have several layers of laminated Lexicon™ sheets, plexiglass sheets, or polycarbonate panels for rendering the laminated windows 120 bullet-proof and shatter-proof. The laminated windows 120 include perimeter window edging 122*a*, 122*b* and 122*c*, a front exterior window surface 124 and a rear interior window surface 126. The perimeter edging 122*a* to 122*c* of laminated windows 120 are positioned and connected between each of the mullion housings 42 and the pressure bar housings 82 using the structural silicone adhesive $A_S$, as depicted in FIGS. 3 and 4 of the drawings.

It is understood, that all of the serrated surfaces $S_F$, $S_{IT}$, $S_T$, $S_{ET}$, $S_{RIP}$, $S_{EP}$ and $S_{IP}$ are used for receiving of structural silicone adhesive $A_S$ thereon, such that these aforementioned serrated surfaces $S_F$, $S_{EP}$ and $S_{RIP}$ along with the structural silicone adhesive $A_S$ are for receiving the perimeter edging 122*a*, 122*b* and 122*c* of laminated windows 120 in order to lock in place the laminated windows 120 to the blast-resistant mullion 40 and pressure bar member 80. Further, the aforementioned serrated surfaces $S_{ET}$ and $S_{IP}$ along with the structural silicone adhesive $A_S$ are for joining together and locking together the mullion tongue 58 of mullion housing 42 to the pressure bar extension arms 92*a* and 92*b* of pressure bar housing 82. Also, the aforementioned serrated surfaces $S_{IT}$ along with the structural silicone adhesive $A_S$ lock the threaded steel bolts 66 within the bolt receiving channel 64 of tongue extension arms 60*a* and 60*b*, as shown in FIG. 3 of the drawings.

The blast-proof window and mullion system 10 has a blast mitigation standard from The Department of Defense (DOD) of at least 1 psi for all newly constructed multi-storied buildings in the United States. Also, the blast-proof window and mullion system 10 has a blast mitigation standard from the DOD of at least 2.5 psi for all newly constructed embassy, federal and military buildings in the United States. Additionally, the blast-proof window and mullion system 10 has a blast mitigation standard from the DOD of at least 8.0 psi for all newly constructed embassy, federal and military buildings outside of the United States.

First Alternate Embodiment 200

Figure 9:
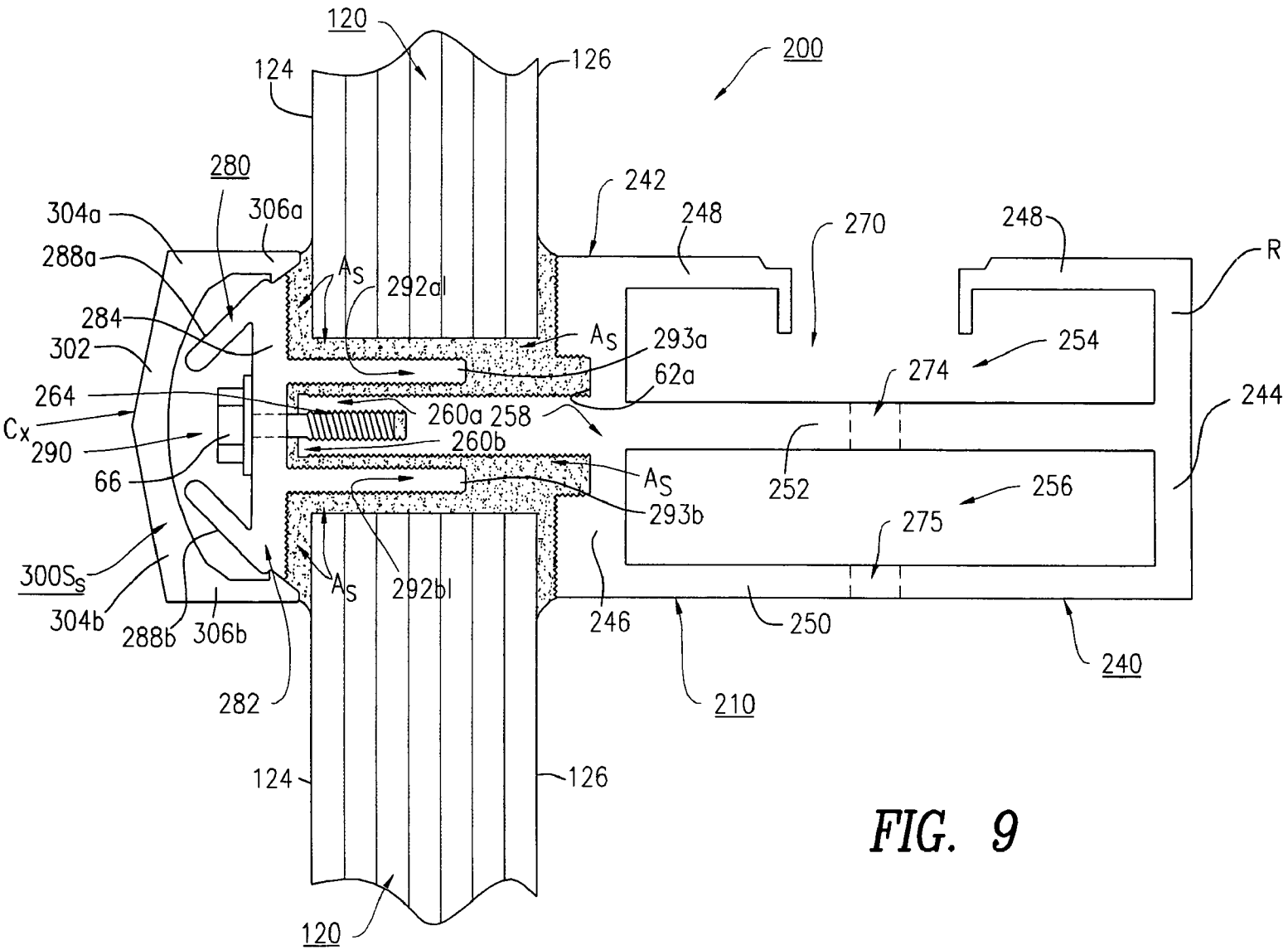
FIG. 9 is a top plan sectional view of the blast-proof window system of the second alternate embodiment of the present invention showing the major component parts of the window system.
Figure 10:
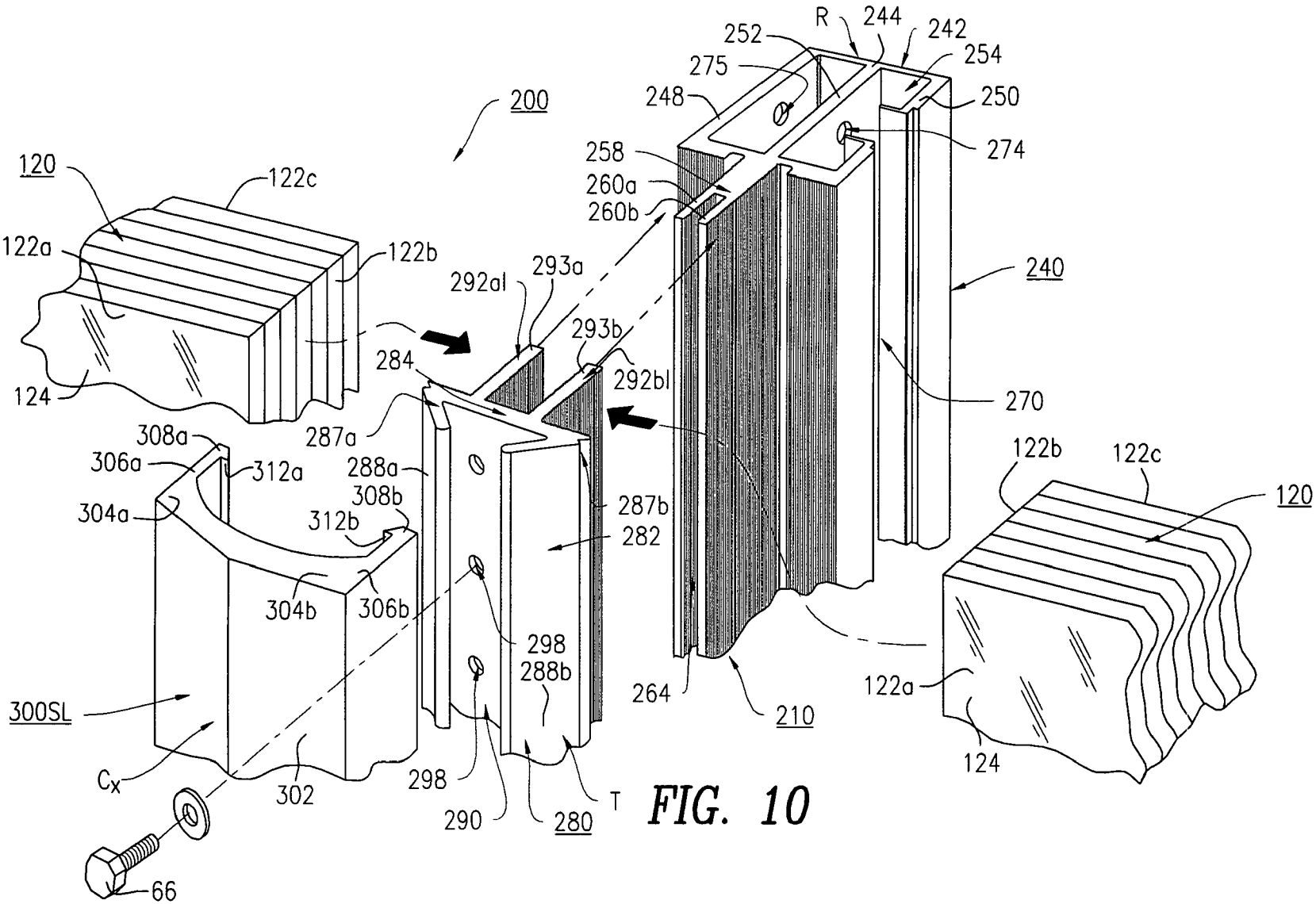
FIG. 10 is an exploded perspective view of the blast-proof window system of the present invention showing a pair of tongue extension arms of the mullion tongue having a smaller arm length as compared to the preferred embodiment.

The blast-proof window and mullion system 210 and their major component parts of the first alternate embodiment 200 of the present invention is represented in detail by FIGS. 9 and 10 of the patent drawings. Elements illustrated in FIGS. 9 and 10 which correspond to the elements described above with reference to FIGS. 3 through 8 of the preferred embodiment 10 have been designated by correspondence reference numbers increased by two hundred.

The first alternate embodiment 200 is similarly constructed and operates in the exactly same manner as the preferred embodiment 10, unless it is otherwise stated. All aspects of the first alternate embodiment 200 of the blast-proof window and mullion system 210 are the same as the preferred embodiment of the blast-proof window and mullion system 10 except for the length of each the pressure bar extension arms 292*a*1 and 292*b*1 of pressure bar housing 282. The pressure bar extension arms 292*a*1 and 292*b*1 of the pressure bar housing 282 are less in total length then the mullion tongue 258 of the mullion housing 242, as shown in FIGS. 9 and 10 of the patent drawings.

In all other respects, the blast-proof window and mullion system 210 of the first alternate embodiment 200 are exactly the same as the blast-proof window and mullion system 10 of the preferred embodiment except for the length of the pressure bar extension arms 292*a*1 and 292*b*1 being shorter in length than the pressure bar extension arms 92*a* and 92*b* of pressure bar housing 82 of window and mullion system 10, such that each of the end sections 293*a* and 293*b* of pressure bar extension arms 292*a*1 and 292*b*1 are not able to be received within each of the spaced-apart mullion receiving slots 262*a* and 262*b* of mullion housing 242, as shown in FIGS. 9 and 10. Further, this first alternate embodiment 200 has a DOD blast mitigation standard of at least 2.5 psi for this structural configuration.

Second Alternate Embodiment 400

Figure 11:
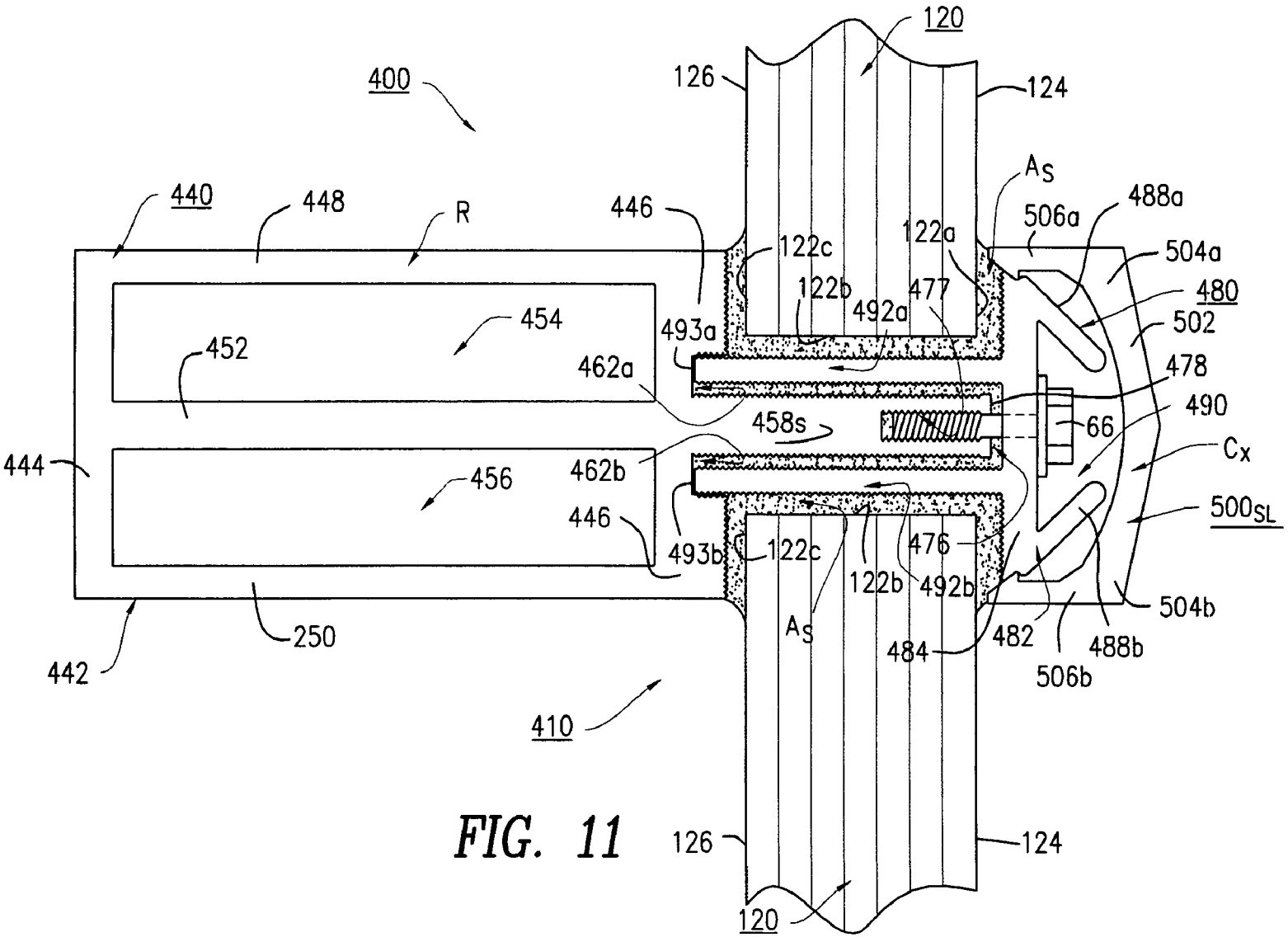
FIG. 11 is a top plan sectional view of the blast-proof window system of the third alternate embodiment of the present invention showing the major component parts of the window system.
Figure 12:
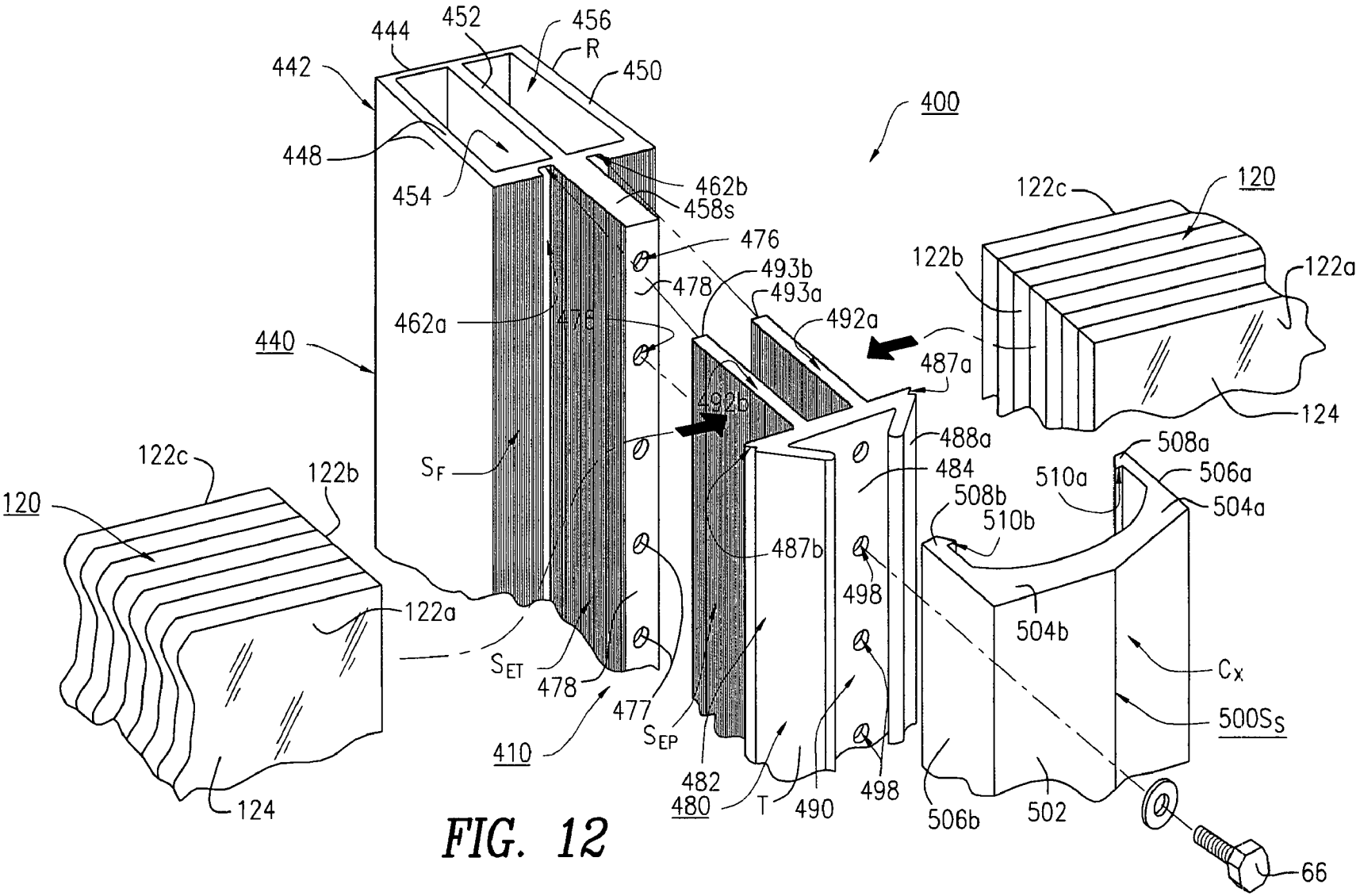
FIG. 12 is an exploded perspective view of the blast-proof window system of the present invention showing a solid mullion tongue having a plurality of spaced-apart and threaded bolt openings therein.

The blast-proof window and mullion system 410 and their major component parts of the second alternate embodiment 400 of the present invention is represented in detail by FIGS. 11 and 12 of the patent drawings. Elements illustrated in FIGS. 11 and 12 which correspond to the elements described above with reference to FIGS. 3 through 8 of the preferred embodiment 10 have been designated by corresponding reference numbers increased by four hundred.

The second alternate embodiment 400 is similarly constructed and operates in the exactly same manner as the preferred embodiment 10, unless it is otherwise stated. All aspects of the second alternate embodiment 400 of the blast-proof window and mullion system 410 are the same as the preferred embodiment of the blast-proof window and mullion system 10, except for the mullion 458*s* of mullion housing 442 being a solid bar B. The solid bar mullion tongue 458*s* of mullion housing 442 includes a plurality of equally spaced-apart threaded bolt openings 476 for receiving threaded steel bolts 66 therein. The equally spaced-apart threaded bolt openings 476 are spaced between every four (4) to eight (8) inches on the end tongue well section 478 of the solid bar mullion tongue 458*s* of mullion housing 442, as shown in FIGS. 11 and 12 of the patent drawings.

In all other aspects, the blast-proof window and mullion system 410 of the second alternate embodiment 400 are exactly the same as the blast-proof window and mullion system 10 of the preferred embodiment, except for the threaded bolt openings 476 having threaded interior channels 477 for receiving each of the threaded steel bolts 66 therein, as depicted in FIGS. 11 and 12.

Further, this second alternate embodiment 400 has a DOD blast mitigation standard of at least 8.0 psi for this structural configuration. This 8.0 psi standard is used for all newly constructed embassy, federal and military buildings outside of the United States.

Operation of the Present Invention

As shown in FIGS. 3 and 4 of the drawings, the blast-proof window and mullion system 10, is assembled in the following manner: The initial step has the builder attaching the mullion housing 42 to the facade facing of a building by attaching a plurality of expansion bolts 72 through the expansion bolts 72 through the expansion bolt opening 70 and through bolt openings 74 and 75 along each vertical axis $V_{M1}$ and $V_{M2}$ respectively, such that the expansion bolts 72 are anchored to the facade to the multi-storied building. This step has the builder also concurrently attaching the pressure bar housing 82 to the mullion housing 42, as well as the laminated windows 120 to the partially assembled mullion housing 42 and pressure bar housing 82. The end sections 93*a* and 93*b* of pressure bar extension arms 92*a* and 92*b* are received within each of the spaced-apart mullion receiving slots 62*a* and 62*b* of mullion housing 42, respectively, along with structural silicone adhesive $A_S$ being applied to serrated surfaces $S_F$, $S_{EP}$, $S_{ET}$, $S_{IP}$, and $S_{RIP}$, respectively, in order to allow the locking and joining together of the pressure bar housing 82 to the mullion housing 42. Also, concurrently, the perimeter edging 122*a*, 122*b* and 122*c* of each of the laminated windows 120 are positioned and connected between each of pressure bar walls 86*a*, 94*a*, 86*c* and 94*b* of pressure bar housing 82 and front wall surfaces 56*a* and 56*b* of mullion housing 42. Structural silicone adhesive $A_S$ is applied to serrated surfaces $S_F$, $S_{EP}$, $S_{ET}$, $S_{IP}$, and $S_{RIP}$, respectively, allowing the laminated windows 120 to be locked in place to the pressure bar member 80 and to the blast-resistant mullion 40. The plurality of equally spaced-apart bolt openings 98, respectively, receive each of the plurality of threaded steel bolts 66. The threaded steel bolts 66 are then received within the vertical bolt receiving channel 64 (formed by the tongue extension arms 60*a* and 60*b*). Structural silicone adhesive $A_S$ is applied to serrated surfaces $S_{IT}$ and $S_{RIP}$ allowing for the permanent locking together of pressure bar extension arms 92*a* and 92*b* with the mullion extension arms 60*a* and 60*b* in order to join together and lock the pressure bar housing 82 of pressure bar member 80 to the mullion housing 42 of blast-resistant mullion 40 for forming of the blast-proof window and mullion system 10 of the present invention. In this manner, the laminated windows 120 are locked within the window and mullion system 10 of the present invention. In the last step, each of the snap-on tabs 110*a* and 110*b* on the cover side walls 106*a* and 106*b*, respectively, of snap-on cover member $100S_S$ are mated for detachably connecting to cover receiving channel 87*a* and 87*b* of pressure bar housing 82 which then attaches the cover member $100S_S$ to the pressure bar member 80, as shown in FIG. 3 of the patent drawings.

During an actual blast, explosion or terrorist attack (gun battle) the cover member $100S_S/100S_L$ is able to deflect and protect the channel opening 90 of the pressure bar member 80 from bullets and/or blast debris. The window and mullion system 10 protects the multi-storied building up to 8.0 psi from any substantial damage to the window and mullion system 10.

Advantages of the Present Invention

Accordingly, an advantage of the present invention is that it provides for a blast-proof window and mullion system for mitigating and sustaining an explosion and/or blast through a plurality of laminated window glass and through the unique and novel blast-proof window system being made from an aluminum alloy 6063TG.

Another advantage of the present invention is that it provides for a blast-proof window and mullion system in conjunction with an improved and novel and bullet-proof bar member.

Another advantage of the present invention is that it provides for a blast-proof window and mullion system wherein the blast-resistant mullion includes a tongue having a pair of tongue extension arms all with serrated surfaces for joining to the pressure bar member.

Another advantage of the present invention is that it provides for a blast-proof window and mullion system having the blast-resistant mullion with a pair of mullion receiving slots being positioned on a front wall in an equally space-apart fashion, wherein the front wall also includes a pair of front wall surfaces with serrated surfaces for joining with the pressure bar member.

Another advantage of the present invention is that it provides for a blast-proof window and mullion system wherein the pair of tongue extension arms of the centrally positioned mullion tongue form a bolt receiving channel therein for receiving a plurality of steel securing bolts there through for locking the pressure bar member to the blast-resistant mullion.

Another advantage of the present invention is that it provides for a blast-proof window and mullion system including the blast-resistant pressure bar member housing with a rear wall and a pair of angled outer walls being integrally connected to the rear wall, wherein the angled outer walls has a channel opening therethrough, such that a reduced sized channel opening is used for reduction of bullet and/or blast penetration to the pressure bar member Another advantage of the present invention is that it provides for a blast-proof window and mullion system wherein the rear wall of the pressure bar member includes a pair of spaced-apart pressure bar arms thereon being centrally positioned, such that each of the pressure bar arms have exterior wall surfaces with serrated surfaces thereon for receiving structural silicone adhesive thereon for locking the pressure bar member to the blast-resistant mullion.

Another advantage of the present invention is that it provides for a blast-proof window and mullion system that is easy to install and assemble and withstand blast mitigation up to 8 psi for a multi-storied building.

A further advantage of the present invention is that it provides for a blast-proof window and mullion system that can be mass-produced in an automated and economical manner and is readily affordable by the builder.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A blast-proof window and mullion system for sustaining and mitigating an explosion and/or blast to said window and mullion system on a structure, comprising:

a) a blast-resistant mullion including a mullion housing having mullion walls with outer surfaces;

b) a pressure bar member including a pressure bar housing having an interior wall and a pair of outer walls being connected to said interior wall to form a channel opening; said outer walls being angled relative to each other for reducing the space between said angled walls and for reducing the size of said channel opening for reduction of bullet and/or blast penetration to said interior wall of said pressure bar member;

c) a cover for overlapping said angled outer walls and for protecting said pressure bar member;

d) a plurality of laminated shatter-proof and bullet-proof windows connected to said mullion housing and said pressure bar housing;

e) one of said mullion walls of said mullion housing including a mullion tongue thereon having a pair of tongue extension arms for forming a vertical bolt receiving channel therebetween;

f) each of said tongue extension arms having interior serrated surfaces for receiving threaded bolts between said interior serrated surfaces;

g) said interior wall of said pressure bar member having a pair of spaced-apart pressure bar extension arms thereon;

h) each of said pressure bar extension arms have exterior and interior serrated surfaces thereon for receiving structural adhesive thereon; and i) said interior wall of said pressure bar member including a plurality of spaced-apart bolt openings for receiving a plurality of said threaded bolts therein for permanently locking together said pressure bar extension arms with said mullion extension arms in order to join together and lock said pressure bar housing of said pressure bar member to said mullion housing of said blast-resistant mullion to form said blast-proof window and mullion system.

2. A blast-proof window and mullion system in accordance with claim 1, wherein at least one of said outer surfaces of said mullion housing includes mullion receiving slots therein.

3. A blast-proof window and mullion system in accordance with claim 2, wherein said mullion housing includes two spaced-apart mullion receiving slots; said pressure bar extension arms each having an end section for inserting into said two mullion receiving slots for locking said mullion housing to said pressure bar housing for forming said blast-proof window and mullion system.

4. A blast-proof window and mullion system in accordance with claim 1, wherein said structural adhesive is a structural silicone adhesive.

5. A blast-proof window and mullion system in accordance with claim 1, wherein each of said laminated windows include a perimeter edging.

6. A blast-proof window and mullion system in accordance with claim 1, wherein one of said outer surfaces of said mullion walls include serrated surfaces for receiving said structural adhesive thereon.

7. A blast-proof window and mullion system in accordance with claim 1, wherein said interior wall of said pressure bar member includes rear interior wall surfaces having serrated surfaces thereon.

8. A blast-proof window and mullion system in accordance with claim 1, wherein said serrated surfaces of one of said outer surfaces of said mullion walls, said exterior serrated surfaces of said pressure bar extension arms and said serrated surfaces of said rear interior wall surfaces of said bar housing all having said structural silicone adhesive thereon for receiving said perimeter edging of said laminated windows in order to lock in place said laminated windows to said pressure bar member and to said blast-resistant mullion.

9. A blast-proof window and mullion system in accordance with claim 1, wherein said mullion walls of said mullion housing includes a center wall for forming a pair of interior channels therethrough.

10. A blast-proof window and mullion system in accordance with claim 9, wherein said center wall of said mullion housing includes a plurality of spaced-apart, center wall bolt openings being aligned in a vertical axis and being centrally positioned on said center wall.

11. A blast-proof window and mullion system in accordance with claim 1, wherein said mullion tongue has a width of 0.75 inches±0.0625 inches.

12. A blast-proof window and mullion system in accordance with claim 1, wherein each of said pressure bar extension arms of said pressure bar housing are shorter in length than said mullion tongue of said mullion housing.

13. A blast-proof window and mullion system in accordance with claim 1, wherein each of said angled outer walls has an angle alpha ($\alpha$) of at least 45° relative to said interior wall of said pressure bar housing.

14. A blast-proof window and mullion system in accordance with claim 1, wherein the width of channel opening of said pressure bar housing is not more than 0.75 inches.

15. A blast-proof window and mullion system in accordance with claim 1, wherein said spaced-apart bolt openings are spaced-apart between every four (4) to eight (8) inches on said interior wall of said pressure bar housing.

16. A blast-proof window and mullion system in accordance with claim 1, wherein one of said mullion walls of said mullion housing is a side mullion wall.

17. A blast-proof window and mullion system in accordance with claim 16, wherein one of said side mullion walls includes an expansion bolt channel opening, such that expansion bolts are received through said expansion bolt channel opening and through said spaced-apart center wall bolt openings and through spaced-apart side mullion wall bolt openings in order to permanently attach said mullion housing to the facade of a building.

18. A blast-proof window and mullion system in accordance with claim 1, wherein said plurality of spaced-apart bolt openings on said interior wall of said pressure bar housing are aligned in a vertical axis and are centrally positioned on said interior wall.

19. A blast-proof window and mullion system in accordance with claim 1, wherein each of said spaced-apart pressure bar extension arms are centrally positioned on said interior wall of said pressure bar housing.

20. A blast-proof window and mullion system in accordance with claim 1, wherein said threaded bolts are made from steel or stainless steel.

21. A blast-proof window and mullion system in accordance with claim 1, wherein said mullion housing and said pressure bar housing are made from an aluminum alloy 6063-T6.

22. A blast-proof window and mullion system in accordance with claim 1, wherein said window and mullion system has a blast mitigation standard from the Department of Defense (DOD) of at least 1 psi for all constructed buildings in the United States.

23. A blast-proof window and mullion system in accordance with claim 1, wherein said window and mullion system has a blast mitigation standard from the DOD of at least 2.5 psi for all federal and military constructed buildings in the United States.

24. A blast-proof window and mullion system in accordance with claim 1, wherein said window and mullion system has a blast mitigation standard from the DOD of at least 8.0 psi for all embassies, and federal and military constructed buildings outside the United States.

25. A blast-proof window and mullion system in accordance with claim 1, wherein said cover is a snap-on cover.

26. A blast-proof window and mullion system in accordance with claim 1, wherein said cover is a slide-on cover.

27. A blast-proof window and mullion system in accordance with claim 1, wherein said cover has an outer wall having a convex-curved shape for deflecting of bullets and blast debris.

28. A blast-proof window and mullion system in accordance with claim 1, wherein said mullion housing is substantially rectangular-shaped.

29. A blast-proof window and mullion system in accordance with claim 1, wherein said pressure bar housing is substantially triangular-shaped.

30. A blast-proof window and mullion system for sustaining and mitigating an explosion and/or blast to said window and mullion system on a structure, comprising:

a) a blast-resistant mullion including a mullion housing having mullion walls with outer surfaces;

b) a pressure bar member including a pressure bar housing having an interior wall and a pair of outer walls being connected to said interior wall to form a channel opening; said outer walls being angled relative to each other for reducing the space between said angled walls and for reducing the size of said channel opening for reduction of bullet and/or blast penetration to said interior wall of said pressure bar member;

c) a cover for overlapping said angled outer walls and for protecting said pressure bar member;

d) a plurality of laminated shatter-proof and bullet-proof windows connected to said mullion housing and said pressure bar housing;

e) one of said mullion walls of said mullion housing including a mullion tongue; wherein said mullion tongue is a solid bar;

f) said solid mullion tongue includes a plurality of spaced-apart bolt openings; each of said bolt openings having a threaded interior bolt channel for receiving a threaded bolt therein;

g) said interior wall of said pressure bar member having a pair of spaced-apart pressure bar extension arms thereon;

h) each of said pressure bar extension arms have exterior and interior serrated surfaces thereon for receiving structural adhesive thereon; and i) said interior wall of said pressure bar member including a plurality of spaced-apart bolt openings for receiving a plurality of said threaded bolts therein for permanently locking together said pressure bar extension arms with said mullion tongue in order to join together and lock said pressure bar housing of said pressure bar member to said mullion housing of said blast-resistant mullion to form said blast-proof window and mullion system.

* * * * *